United States Patent [19]

Moody

[11] Patent Number: 4,858,784

[45] Date of Patent: Aug. 22, 1989

[54] GOLF TEE DISPENSER

[76] Inventor: Robert P. Moody, 6251 Timberlake Dr., E-4, Sarasota, Fla. 34243

[21] Appl. No.: 187,307

[22] Filed: Apr. 28, 1988

[51] Int. Cl.[4] ..... G07F 11/16

[52] U.S. Cl. ..... 221/155; 221/307; 221/281; 221/283

[58] Field of Search ..... 221/303, 307, 309, 155, 221/255–257, 260, 283, 282, 304, 281; 248/205.2; 224/191, 251

[56] References Cited

U.S. PATENT DOCUMENTS

| | | | |
|---|---|---|---|
| 1,297,205 | 3/1919 | McLaren | 221/307 X |
| 1,496,491 | 6/1924 | Ringler | 221/307 |
| 1,718,952 | 7/1929 | Fischer | 221/307 |
| 2,232,425 | 2/1941 | Balton | 221/307 X |
| 3,273,891 | 9/1966 | Grim, Jr. | 248/205.2 X |
| 3,412,897 | 11/1968 | Slater | 221/309 X |
| 3,435,987 | 4/1969 | Saunders et al. | 221/304 X |
| 3,729,421 | 4/1973 | Gibson et al. | 221/307 X |
| 3,892,334 | 7/1975 | Hand, II et al. | 221/307 |
| 4,082,209 | 4/1978 | Sanders | 221/309 X |
| 4,106,678 | 8/1978 | Thomas | 221/309 X |
| 4,132,329 | 1/1979 | Harrison | 221/155 X |
| 4,261,480 | 4/1981 | Fuss | 221/304 |

FOREIGN PATENT DOCUMENTS

| | | | |
|---|---|---|---|
| 101042 | 2/1965 | Denmark | 248/205.2 |
| 977938 | 12/1964 | United Kingdom | 248/205.2 |

*Primary Examiner*—Joseph J. Rolla
*Assistant Examiner*—Stephen B. Parker
*Attorney, Agent, or Firm*—Charles J. Prescott; Raymond H. Quist

[57] ABSTRACT

A golf tee dispenser including a length of rigid cylindrical tubing adapted to receive a plurality of golf tees therein and a thin elastic member disposed and held in tension transversely through the center of longitudinal axis of the tube and through and between opposing apertures formed in the walls of the tube adjacent one end. The elastic member is adapted, when tensioned, to retain the golf tees within the tube and to manually dispense one golf tee at a time when the tube is generally upright, the elastic member and apertures are at the lower end thereof, and the golf tees are downwardly pointed. Various forms of the elastic member are also provided, along with releasable engagement means for attachment of the dispenser to golf equipment such as bags and carts.

8 Claims, 1 Drawing Sheet

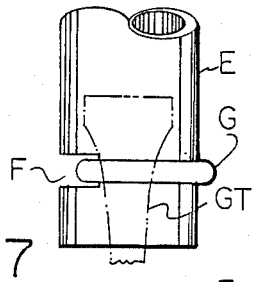
FIG. 7
PRIOR ART
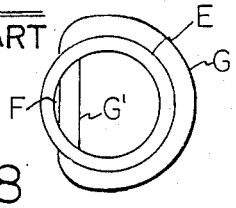
FIG. 8
PRIOR ART
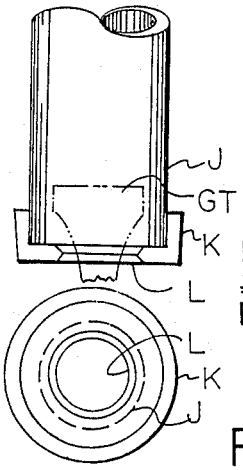
FIG. 9
PRIOR ART
FIG. 10
PRIOR ART
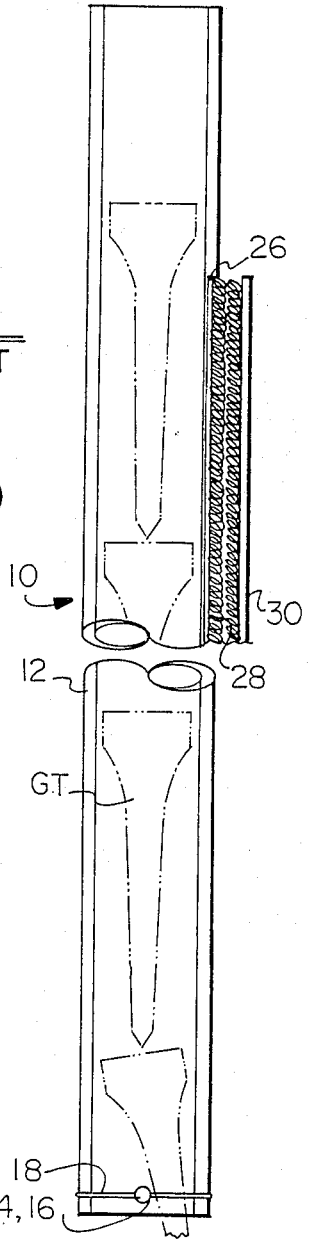
FIG. 1
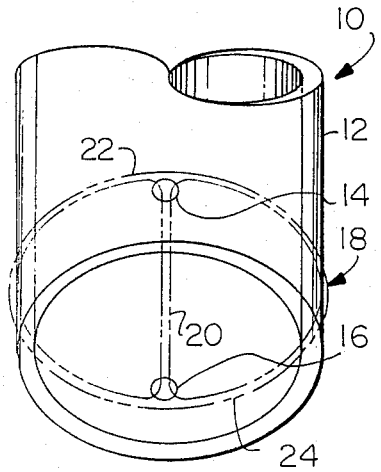
FIG. 3
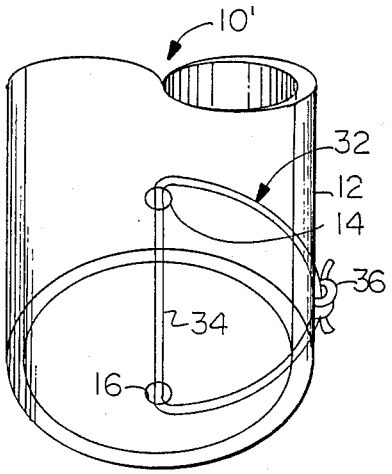
FIG. 4
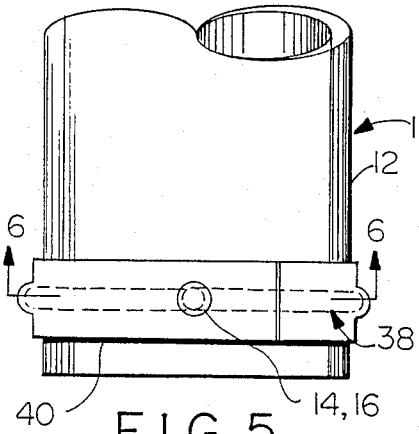
FIG. 5
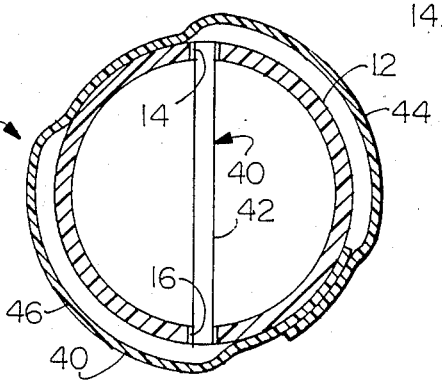
FIG. 6
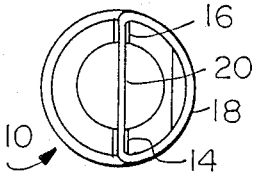
FIG. 2

GOLF TEE DISPENSER

BACKGROUND OF THE INVENTION

This invention generally relates to accessories for playing the game of golf, and more particularly to a golf tee dispensers adapted to contain and manually dispense golf tees.

Retaining golf tees in a container for ready access within other than the golfer's pocket or wedged behind his ear has always been a major obstacle to the playing of a round of golf. However, prior art discloses devices which, to some extent, provide a more civilized means for dealing with this problem.

Referring to the drawings, FIGS. 7 through 10 disclose two prior art devices which attempt to serve this need. Referring firstly to FIGS. 7 and 8, that prior art device includes an elongated cylindrical tube E having a transversely cut groove F forming an inwardly extending sector line with respect to the circular cross section of tube E. Elastic O-ring G is fitted within groove F and circumferentially around tube E. By this arrangement, O-ring portion G′ must be outwardly flexed in order to manually dispense a golf tee GT.

The prior art device depicted in FIGS. 9 and 10 also includes an elongated tube J provided at its lower end with a tight fitting flexible cup K having an aperture L centrally therethrough. Cup K is intended to snuggly fit over the end of tube J so that, when a golf tee GT is manually dispensed, aperture L is flexibly expanded and enlarged to allow the golf tee GT to pass therethrough one at a time.

However, both of these prior art devices pose problems in function and operation. The first prior art device shown in FIGS. 7 and 8 tends to allow the pointed lower end of each golf tee GT to pass on the wrong side of O-ring segment G′ making manual dispensing impossible, while the flexible cup K of the embodiment in FIGS. 9 and 10, even when glued in place, tends to detach from tube J during the downward force exerted thereon by manual dispensing of a golf tee GT.

The present invention provides a golf tee dispenser which clearly avoids both of the above-referenced problems and provides unique and simple structure for achieving the intended function of both storing a plurality of golf tees while manually dispensing one golf tee at a time consistently.

BRIEF SUMMARY OF THE INVENTION

This invention is directed to a golf tee dispenser including a length of rigid cylindrical tubing adapted to receive a plurality of golf tees therein and a thin elastic member disposed and held in tension transversely through the center or longitudinal axis of the tube and through and between opposing apertures formed in the walls of the tube adjacent one end. The elastic member is adapted, when tensioned, to retain the golf tees within the tube and to manually dispense one golf tee at a time when the tube is generally upright, the elastic member and apertures are at the lower end thereof, and the golf tees are downwardly pointed. Various forms of the elastic member are also provided, along with releasable engagement means for attachment of the dispenser to golf equipment such as bags and carts.

It is therefore an object of this invention to provide a golf tee dispenser which will contain and store a plurality of conventional golf tees while manually and consistently dispensing one golf tee at a time.

It is another object of this invention to provide a golf tee dispenser which is easily manufactured and which is conveniently serviceable when replacement elastic cord or rubber band members are required.

It is yet another object of this invention to provide a golf tee dispenser which is easily attachable to golf equipment such as golf bags and golf carts.

It is yet another object of this invention to provide a golf tee dispenser which conveniently displays the quantity of golf tees stored therein.

In accordance with these and other objects which will become apparent hereinafter, the instant invention will now be described with reference to the accompanying drawings in which:

BRIEF DESCRIPTION OF THE DRAWINGS

FIG. 7 is a side elevation view of the lower end portion of one prior art device.

FIG. 8 is a bottom plan view of FIG. A.

FIG. 9 is a side elevation view of the lower end portion of another prior art device.

FIG. 10 is a bottom plan view of FIG. C.

FIG. 1 is a side elevation view of the preferred embodiment of the invention.

FIG. 2 is a bottom plan view of FIG. 1.

FIG. 3 is an enlarged perspective view of the lower end portion of FIG. 1 depicting the elastic rubber band schematically.

FIG. 4 is a view similar to FIG. 3 showing an alternate embodiment of the elastic golf tee retaining member.

FIG. 5 is a side elevation view of the lower end portion of yet another embodiment of the elastic golf tee retaining member.

FIG. 6 is a section view in the direction of arrows 6—6 in FIG. 5.

DETAILED DESCRIPTION OF THE INVENTION

Referring now to the drawings, and firstly to FIGS. A to D, two prior art devices are there shown and have been previously described in the background portion of this specification and will not be rediscussed here.

Referring, then to FIGS. 1, 2 and 3, the preferred embodiment of the invention is shown generally at 10 and includes an elongated cylindrical transparent tube 12 having apertures 14 and 16 transversely disposed generally in registry and alignment one to another and with the longitudinal axis of tube 12 adjacent the lower end of tube 12. The interior diameter of tube 12 is chosen to freely and slidably receive the enlarged head of a conventional golf tee GT. The length of tube 12 is selected to accommodate a plurality of these golf tees GT, each being loaded into the tube 12 in a downwardly pointed direction as shown. The preferred material for tube 12 is a transparent plastic.

As may be best seen in FIG. 3, a conventional elastic band 18 serves as the elastic golf tee retaining member which, when the device 10 is in an upright position, prevents golf tees GT from falling from the otherwise open end of tube 12. The elastic band 18 is installed through aligned apertures 14 and 16 by first flatening its sides together and feeding one end through each aperture 14 and 16. Thereafter, one loop end 22 extending out from aperture 16 is wrapped around the periphery of tube 12 while end portion 24 outwardly extending from aperture 14 is also wrapped in the opposite direction transversely around the periphery of tube 12 as shown. By this arrangement, then, the central portion 20 comprising the two adjacent stretched portions of the elastic band 18 provides the golf tee retaining and dispensing function wherein the lowest golf tee GT extending beyond the lower end of tube 12 may be grasped and pulled therefrom.

As can be readily seen now with regard to this embodiment 10 of the invention, as with all embodiments, generally the invention provides an elastic tensioned member transversely disposed through aligned apertures 14 and 16 which positions the elastic member centrally across the open lower end of tube 12. Therefore, the pointed end of a conventional golf tee GT may pass on either side of this tensioned elastic member and be easily removed manually from the tube 12 for use.

Tube 12 is also provided with recessed flat 26 having a length of hooked material 28 which releasably engages to a length of looped material 30. Hooked portion 28 is adhesively attached to recess 26 while loop portion 30 may be adhesively attached to a piece of golf equipment such as a golf bag or golf cart. By this arrangement, then the dispenser 10 may be conveniently attached to, and disengaged from, the golf equipment for use and refilling, respectively.

Referring now to FIG. 4, another embodiment of the invention is shown generally at 10' and includes the same elongated tube 12 having apertures 14 and 16 disposed as previously described. However, in this embodiment, the elastic member shown generally at 32 is formed of a length of elastic cord having been passed through apertures 14 and 16 so that its midportion 34 is disposed therebetween and across the opening of the lower end of tube 12. The cord 32 is then tensioned slightly and tied at knot 36 so that only one half of the periphery of tube 12 is surrounded by elastic cord 32. Otherwise, this embodiment 10' functions as previously described, containing golf tees GT within tube 12 in an upright configuration while conveniently manually dispensing one golf tee GT at a time.

Referring lastly to FIGS. 5 and 6, another embodiment of the invention is shown generally at 10'' and includes the same cylindrical tube 12 having apertures 14 and 16 as previously described. In this embodiment, however, a length of elastic cord 40 is disposed having its central portion 42 passing between apertures 14 and 16 and, after tensioning, having its end portions 44 and 46 adhered in place between a length of elastic tape 40 and the tube 12. The tape 44 completely transversely surrounds the periphery of tube 12 and traps the ends 44 and 46 of elastic cord 40 therebeneath.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A golf tee dispenser for receiving, holding and dispensing a plurality of golf tees comprising:

an elongated rigid generally straight cylindrical tube having open ends and having an inside wall with an interior diameter sized to receive the enlarged head of a conventional golf tee for free sliding movement therein without permitting the shank of one tee from passing the head of a tee below it;

two diametrically opposed apertures in wall portions of said tube adjacent one of its open ends;

a relatively thin, elongated elastic member disposed in tension through and between said apertures permitting the shank of a tee to pass on either side thereof;

said elastic member tensioned sufficiently to retain golf tees within said tube unless manually removed and extendible sufficiently to be displaced to said inside wall of said tube as a tee is manually removed.

2. A golf tee dispenser as set forth in claim 1, wherein:

said elastic member transversely surrounds approximately one half of the periphery of said tube;

said elastic member having two ends knotted together to retain said tensioning.

3. A golf tee dispenser as set forth in claim 1, wherein:

said elastic member is a continuous loop rubber band having a doubled mid portion passing through and between said apertures and end portions wrapped transversely around the periphery of said tube in opposite directions therearound.

4. A golf tee dispenser as set forth in claim 1, wherein:

said elastic member has end portions extending outwardly from said apertures and retained against the outer periphery of said tube by a length of adhesive wrapped therearound.

5. A golf tee dispenser as set forth in claim 1, wherein:

said tube is transparent.

6. A golf tee dispenser as set forth in claim 1, further comprising:

releasable adhesive means along a portion of the length of said tube for interengagement of said dispenser to a piece of golf equipment.

7. A golf tee dispenser for receiving, holding and dispensing a plurality of golf tees comprising:

an elongated rigid generally straight cylindrical tube having open ends and having an inside wall with an interior diameter sized to receive the enlarged head of a conventional golf tee for free sliding movement therein without permitting the shank of one tee from passing the head of a tee below it;

two diametrically opposed apertures in wall portions of said tube adjacent one of its open ends;

a relatively thin, elongated continuous loop rubber band having a doubled mid portion disposed in tension through and between said apertures and having portions extending from said apertures wrapped around the periphery of said tube in opposite directions, said doubled mid portion permitting the shank of a tee to pass on either side thereof;

said rubber band tensioned sufficiently to retain golf tees within said tube unless manually removed and extendible sufficiently to be displaced to said inside wall of said tube as a tee is manually removed.

8. A golf tee dispenser for receiving, holding and dispensing a plurality of golf tees comprising:

an elongated rigid generally straight cylindrical tube having open ends and having an inside wall with an interior diameter sized to receive the enlarged head of a conventional golf tee for free sliding movement therein without permitting the shank of one tee from passing the head of a tee below it;

two diametrically opposed apertures transversely through in wall portions of said tube adjacent one of its open ends;

a relatively thin, elongated elastic member having two ends knotted together disposed in tension through and between said apertures permitting the shank of a tee to pass on either side thereof;

said elastic member tensioned sufficiently to retain golf tees within said tube unless manually removed and extendible sufficiently to be displaced to said inside wall of said tube as a tee is manually removed.

* * * * *